United States Patent [19]

Alheritiere et al.

[11] Patent Number: 4,878,966

[45] Date of Patent: Nov. 7, 1989

[54] WROUGHT AND HEAT TREATED TITANIUM ALLOY PART

[75] Inventors: Edouard Alheritiere, Ugine; Bernard Prandi, Faverges, both of France

[73] Assignee: Compagnie Europeenne du Zirconium Cezus, Courbevoie, France

[21] Appl. No.: 262,792

[22] Filed: Oct. 26, 1988

Related U.S. Application Data

[62] Division of Ser. No. 181,715, Apr. 14, 1988, Pat. No. 4,854,977.

[30] Foreign Application Priority Data

Apr. 16, 1987 [FR] France ..... 87 05786

[51] Int. Cl.[4] ..... C22F 1/18

[52] U.S. Cl. ..... 148/421; 148/11.5 F

[58] Field of Search ..... 148/421, 11.5 F

[56] References Cited

U.S. PATENT DOCUMENTS 4,309,226 1/1982 Chen ..... 148/421

4,631,092 12/1986 Ruckle ..... 148/11.5 F

FOREIGN PATENT DOCUMENTS 1356734 6/1974 United Kingdom .

OTHER PUBLICATIONS

Redden in "Beta Ti-Alloys in the 1980" Ed. R. R. Boyer et al., Met. Soc. Aime, Symp. Atlanta '83, p. 239.

*Primary Examiner*—Upendra Roy

*Attorney, Agent, or Firm*—Dennison, Meserole, Pollack & Scheiner

[57] ABSTRACT

A wrought and heat treated titanium alloy part is disclosed having the composition, by w eight, Al 4.5 to 5.4%, Sn 1.8 to 2.5%, Zr 3.5 to 4.8%, Mo 2.0 to 4.5%, Cr 1.5 to 2.5%, Cr+V 1.5 to 4.5%, Fe 0.7 to 1.5%, O 0.07 to 0.13%, the remainder being Ti and impurities. The part is characterized by a fine and regular alpha-beta structure and essentially segregation free microstructures, and has the mechanical characteristics: $Rm \geqq 1200$ MPa, $R_{p0.2} \geqq 1000$ MPa, $A\% \geqq 5$, $K_{1c}$ at 20° C. $\geqq 45$ MPa.$\sqrt{m}$, creep at 400° C. under 600 MPa:0.5% in more than 200 hours.

2 Claims, No Drawings

WROUGHT AND HEAT TREATED TITANIUM ALLOY PART

This is a continuation of co-pending application Ser. No. 181,715 filed on Apr. 14, 1988 now U.S. Pat. No. 4,854,977.

The invention relates to a process for the production of a titanium alloy part with good characteristics, intended for use e.g. as compressor disks for aircraft propulsion systems, as well as to the parts obtained.

FR 2 144 205 (GB 1356734) describes a titanium alloy with the following composition by weight: Al 3 to 7, Sn 1 to 3, Zr 1 to 4, Mo 2 to 6, Cr 2 to 6 and up to approximately 0.2% O, 6% V, 0.5% Bi, the remainder being Ti and impurities. The preferred values are Al 4.5 to 5.5, Sn 1.5 to 2.5, Zr 1.5 to 2.5, Mo 3.5 to 4.5, Cr 3.5 to 4.5 and up to approximately 0.12% O. The corresponding forged parts or forgings undergo a double heat treatment of the solid solution firstly between 730° and 870° C. and then between 675° and 815° C., followed by thermal ageing or annealing at between 595° and 650° C. Sample 4 (Al 5-Sn 2-Zr 2-Mo 4-Cr 4-O 0.08) has the following mechanical characteristics: breaking load 1204 MPa, elastic limit at 0.2% 1141 MPa, crack propagation resistance $88\times34.8/\sqrt{1000}=96.9$ MPa. $\sqrt{m}$, creep at 425° C. under 525 MPa=0.2% elongation in 7.2 h and 0.5% elongation in 55 h. The breaking elongation is not given. In practice it has been found that the parts obtained on the basis of this composition and process often had significant segregations leading to ductility and crack propagation resistance (tenacity) losses, whilst also having an inadequate creep resistance. It was found that the aforementioned segregations corresponded to areas enriched in Cr, then causing an embrittlement and that a reduction of the Cr content led to inadequate mechanical properties.

The Applicant attempted to obtain parts of the same type of alloy with a regular structure, no segregations and high mechanical characteristics at 20° C. ($R_m$-$R_{p0.2}$-$K_{1C}$) with an adequate elongation, as well as a significantly improved creep behaviour at 400° C.

DESCRIPTION OF THE INVENTION

According to the invention, the aforementioned problem is solved by means of new composition limits and a new transformation process, said composition limits and the hot working and heat treatment conditions then being inseperable.

The invention firstly relates to a process for the production of a titanium alloy part involving the following stages:

(a) the production of an ingot of composition (% by weight): Al 3.8 to 5.4, Sn 1.5 to 2.5, Zr 2.8 to 4.8, Mo 1.5 to 4.5, Cr equal to or below 2.5 and Cr+V=1.5 to 4.5, Fe<2.0, Si<0.3, O<0.15, Ti and impurities constituting the residue;

(b) the ingot undergoes hot working, involving a rough-shaping working of said ingot giving a hot blank, followed by the final working of at least a portion of said blank preceded by preheating in the beta range, said final working giving a blank of the part;

(c) the hot worked part blank is solid solution heat treated, whilst maintaining it at a temperature between (real "beta transus" −40° C.) and (real "beta transus" −10° C.), followed by cooling it to ambient temperature;

(d) ageing heat treatment of 4 to 12 h at between 550° and 650° C. is then performed on the blank of the part or on the part obtained from said blank.

With respect to stage (b), the expression "hot working" relates to any hot deformation operation consisting or comprising e.g. forging, rolling, die forging or extrusion.

The limits of the contents of addition elements have been adjusted, as a function of the observations made, so as to provide the desired high mechanical characteristics, whilst avoiding possible segregations on the transformed parts. Comments are made on these content ranges hereinafter with an indication of the preferred ranges, which can be used individually or in random combination. These preferred ranges correspond to an increase in the minimum characteristics and in the case of iron and oxygen provide additional security against possible embrittlements or lack of ductility.

The alphagenic elements Al and Sn respectively give, in combination with the other addition elements, inadequate hardness levels when they have contents below the minimum chosen values, whilst giving frequent or random precipitations when used in contents higher than the maximum stipulated values. They have preferred contents between 4.5 and 5.4% for Al and between 1.8 and 2.5% for Sn.

Zr has an important hardening function and an embrittling effect above 5%, the Zr content being preferably between 3.5 and 4.8% and more especially between 4.1 and 4.8%. The three elements Al, Sn and Zr do not together lead to embrittlement and it is pointed out that the sum:

$$\%\ Al+\%\ Sn/3+\%\ Zr/6$$

taken as a reference in Fr 2 144 205 with regards to the formation tendency of the compound $Ti_3Al$, is equal to 7 for their maximum contents.

Mo, which has a slight hardening effect, has an important effect of lowering the temperature of transformation of the alpha-beta structure into an entirely beta structure hereinafter called "beta transus". The lowering of the "beta transus", e.g. by approximately 40° due to 4% Mo, influences the hot working close to this temperature. The Mo content is preferably between 2.0 and 4.5%. V has largely the same function as Mo and has a beta hardening effect by precipitation like Cr, and is added optionally, (Cr+V) being kept at between 1.5 and 4.5%. Cr is limited to max. 2.5% in view of the segregation risks which, at the level of Cr=3.5 to 4.5% recommended in FR 2 144 205 (e.g. segregations called "beta flecks" enriched in Cr+Zr), have very unfavourable effects on the service behaviour and is preferably kept above 1.5% to the benefit of the hardness.

Fe leads to a hardening by precipitation of intermetallic compounds and is known to lower the hot creep behaviour at high temperature (approximately 550° to 600° C.) due to these precipitates, which thus lead to a certain brittleness. The Fe content is in all cases kept below 2% and is preferably adjusted between 0.5 and 1.5%, because it then surprisingly leads to a greatly improved creep behaviour at 400° C., which is interesting e.g. for parts used in "average temperature" stages (typically 350 to less than 500° C.) of aeronautical compressors.

As is known, an increase in the O content improves the mechanical strength and slightly reduces the tenacity ($K_{1C}$), so that it is limited to a maximum of 0.15% and is preferably kept equal to or below 0.13%. A small Si addition improves the creep behaviour at 500° to 550° C., but it is limited to max. 0.3% with a view to obtaining an adequate ductility.

It was found that significantly superior properties were obtained by finishing the hot working with a final working, by rolling or usually by forging or die forging, preceded by preheating in the beta range, i.e. at least commenced in the beta range.

The working ratio "S/s" (initial section/final section) of said final working is preferably equal to or above 2.

Contrary to what was used it was also found to be preferable to accurately know, e.g. to within ±10° to 15° C., the real "beta transus" temperature of the hot worked alloy. For this purpose, samples were typically taken from the hot blank obtained by rough-shaping (forging or rolling) and these samples were raised and maintained at different graded temperatures, followed by water-tempering and micrographic structural examination. The "beta transus", optionally evaluated by intrapolation, is the temperature at which any trace of the alpha phase disappears. Thus, the real "beta transus" of the hot worked alloy determined experimentally can differ widely from the transus temperature estimated by calculation (first series of tests).

The consequences of this knowledge of the real "beta transus", designated in this way or simple as "beta transus", on the choice of the final beta rough working temperature (stage b)) and then on the adjustment of the temperature of placing the blank of the hot worked part into solid solution (stage d) are important. It is therefore highly preferable for obtaining the desired structure and properties to carry out this solution treatment in the upper part of the alpha-beta temperature range just below the experimentally determined "beta transus", or so that it can e.g. be determined as hereinbefore or by successive forging tests, followed by tempering and the examination of the structures obtained. More specifically, this solution treatment is conventionally performed at a temperature chosen between the "beta transus" −40° C. and the "beta transus" −10° C., whilst maintaining the temperature for between 20 minutes and 2 hours and most usually between 30 minutes and 90 minutes. This solution treatment is followed by cooling to ambient conditions in water or more usually air. This is followed by aging at between 550° and 650° C., so as to improve the elongation at break A% and the creep resistance at 400° C., whilst still retaining an adequate mechanical strength and tenacity ($R_m$-$R_{p0.2}$ and $K_{1C}$).

Superior results, particularly with regards to the elongation A% and the creep resistance at 400° C. were surprisingly obtained by organising the final hot working, if necessary by a wider spacing of successive deformation passes, so that in beta it starts at a temperature at least 10° C. above said "beta transus" and ends in alpha-beta, all said work taking place at a temperature within ±60° C. of said "beta transus". It is preferable to start the working at a temperature between the "beta transus" +20° C. and "beta transus" +40° C. and to terminate it at a temperature below the "beta transus" and at least equal to the "beta transus" −50° C. or even better at a temperature between "beta transus" −10° C. and "beta transus" −40° C. This reproducibly gives a fine acicular structure of the alpha-beta type, corresponding to a particular homogeneity state and fine precipitation, thus contributing to obtaining remarkable properties.

It is preferable to at least carry out the end of the hot rough-shaping of the ingot, prior to the final hot working described hereinbefore, in alpha-beta between "beta transus" −100° C. and "beta transus" −20° C. This leads to a better prior refining of the microstructure with a favourable effect on the quality of the parts ultimately obtained. The temperature at the end of hot working is considered here to be the core temperature of the product, e.g. evaluated by a prior study of the microstructures obtained by varying the final hot working conditions.

Finally, in the case where the final hot working is performed in the preferred way, the ageing temperatures and durations are typically between 570° and 640° C. and between 6 and 10 hours.

A second object of the invention is the process for the transformation of a titanium alloy part, typically for uses at temperatures not exceeding 500° C. and corresponding to the preferred conditions described hereinbefore, with Fe=0.7 to 1.5%, Zr=3.5 to 4.8% and preferably 4.1 to 4.8%, the end of the at least rough-shaping consisting of forging at a temperature between the "beta transus" −100° C. and the "beta transus" −20° C., said forging producing a working ratio of at least 1.5 and ageing being typically for 6 to 10 hours at between 580° and 630° C.

A third object of the invention is the remarkable parts obtained with the aforementioned process constituting the second object of the invention, with Zr=3.5 to 4.8 and the following mechanical properties: Rm≧1200 MPa, $R_{p0.2}$≧1100 MPa, A%≧5-tenacity (=crack propagation resistance) $K_{1C}$ at 20° C.≧45 MPa.$\sqrt{m}$ and creep at 400° C. under 600 MPa: 0.5% in more than 200 h.

The inventive process leads to the following advantages:

reproducibly obtaining a fine acicular structure with no segregations of any types;

elimination of embrittlement risks;

simultaneous obtaining of all the desired characteristics: aforementioned mechanical characteristics and structure.

TESTS

First series of tests (Tables 1 to 6)

Six ingots A D E H J K were produced in a consumable electrode furnace by double melting, the compositions obtained being given in Table 1. Each ingot underwent a first beta rough-shaping at 1050°/1100° C. from the inital diameter ϕ200 mm to the square ⧄ 80 mm. Then, for a first portion of each, there was a second refining rough-shaping of the alpha-beta structure by flat forging from 70×30 mm at a temperature (preheating temperature) equal to 50° C. below the estimated transus temperature for each of the six alloys (Table 2). This estimate was made in accordance with an internal approach rule taking account of the contents of the addition elements.

The samples taken at this stage then underwent heating operations for 30 minutes at different temperatures graded by 10° C. stages, followed on each occasion by water-tempering and micrographic examination of the structures took place. Thus, for each hot worked alloy, the alpha phase disappearance or real "beta transus" temperature was determined (Table 2).

The temperature of the second alpha-beta rough-shaping ranged, according to the alloy, from "beta transus" −170° C. (reference H) to "beta transus" −40° C. (reference E) or "beta transus" −60° C. (reference K).

This was followed by three variants corresponding to different transformation and heat treatment ranges and the mechanical characteristics were measured in the longitudinal direction L and optionally the transverse direction T:

First range (Table 3): following the aforementioned alpha-beta forging then constituting the final forging, solution treatment 1 h at "beta transus" −50° C. (Table 2) and measurement of the mechanical characteristics under ambient conditions in the state obtained. Tensile creep tests were carried out under 600 MPa and at 400° C. following complimentary ageing for 8 hours at the indicated temperature for each alloy in Table 2.

Second range (Table 4): the portions of the squares of 80 mm, except square II, from the first beta rough-shaping were used and a second alpha-beta rough-shaping was carried out in square ⧄ 65 mm, in a temperature adjusted to 50° C. less than the previously determined real "beta transus" (Table 2).

On said square was then performed a final flat forging from 70×30 mm, starting with a preheated state for 30 minutes at "beta transus" +10° C. and terminating in alpha-beta, giving fine alpha-beta acicular structures. The parts were then solution treated 1 h at read "beta transus" −30° C. (Table 2) as in the first range, followed by ageing for 8 hours either at 550° C. (A2) or at 500° C. (D2 E2 J2 K2). The mechanical characteristics at 20° C. and the creep resistance at 400° C. are measured in this aged state.

Third range (Table 5): to a portion of the 70×30 mm flats obtained in the second range was applied a supplementary final forging at 60×30 mm starting from "beta transus" +30° C. and also finishing in alpha-beta (acicular structures with alpha phase borders were micrographically observed).

For each of the alloys, this was followed by the same heat treatments (dissolving and ageing) as in the second range.

The study of these results gives rise to the following comments: the classifications of the alloys as regards mechanical strength and tensile creep resistance at 400° C. are as follows for the first and second ranges:

TABLE 6

| | $R_m + R_p 0.2$ | creep duration for 0.5% elongation |
|---|---|---|
| First range | J1-A1-D1-K1-N1-E1 | K1-E1-D1-J1-A1-H1 |
| Second range | D2-J2-E2-K2-A2 | J2-K2-A2-D2-E2 |

These classifications differ widely for the two ranges. The samples of the first range have a final forging at a lower temperature than those of the second range and in addition said forging was performed at a temperature significantly displaced with respect to the real "beta transus" of the alloy, e.g. 110° less than said transus for Al and 40° less for El.

K is a control centered in the analysis recommended by FR 2 144 205. H is another control without Sn and without Zr giving in this first series inadequate mechanical strength and creep behaviour characteristics. The comparison of the results of the first and second ranges show the importance of a final forging starting in beta. The comparison of the results of the second and third ranges shows that the increase in the temperature of the start of said final forging to above "beta transus", leading here to a better preheating homogenization and a larger proportion of the final working in the beta range, leads to a significant increase in the mechanical strength and consequently with the possibility of obtaining a more interesting compromise as regards characteristics following the adjustment of the ageing conditions. This also shows the importance of a precise regulation of the final forging temperature with respect to the real "beta transus" of the alloy. Alloys D, J and E would appear to be particularly interesting (mechanical strength and creep behaviour observed for the second range), provided that the ageing temperature is choosen to above 550° C. The first two respectively contain 2.1 and 1.9% iron.

Second series of tests (Tables 7 to 9)

New ingots were produced with Al contents close to 5% and higher Zr contents than in the first series of tests. The compositions of the five ingots chosen in this example are given in Table 7. Only the ingot designated FB contains 1.1% iron. Each ingot firstly underwent a first press rough-shaping in beta at 1050° C. from the intial diameter $\phi$200 mm to the square ⧄ 40 mm.

The real "beta transus" of these five alloys was determined at this stage in accordance with the method described for the first series of tests.

The 140 mm squares were then forged to 80 mm squares on the basis of a preheating at ("beta transus" −50° C.) followed by flat final forging of 70×30 mm starting from real "beta transus" +30° C.

On the basis of the structures obtained, the end of this forging was in alpha-beta at more than ("beta transus" −80° C.) for all the alloys except for KB. Micrography of KB revealed an all beta structure with unmodified beta grain contours.

Following the final forging, the hot worked blanks obtained were heat treated solution treated for 1 hour at (alloy "beta transus" −30° C.) followed by cooling in air and ageing for 8 hours at a temperature chosen by a special procedure (Table 8).

This procedure consisted of the treatment of small samples at graded temperatures, followed by measurements of the microhardness $H_v$ 30 g and plotting the hardness curve as a function of the treatment temperature, the temperature chosen for annealing then corresponding to the minimum hardness +10%.

The final forging and heat treatment temperatures are given in Table 8 and the results of the mechanical tests in Table 9.

Alloy KB has a catastrophic elongation A%, which shows the importance of finishing the final forging in alpha-beta (acicular structure with alpha borders), in order to have an adequate ductility. This alloy could have been of interest if its final forging had been slowed down so as to finish in alpha-beta.

Among the samples obtained, FB and GB represent the best compromises of the different properties, including A% and the creep resistance at 400° C. FB, which is the best of the two, specially as regards creep (384 h for 0.5% elongation) contains 5.4% Al, 4.2% Zr and 1.1% Fe. Micrography reveals that AB2 has segregations (beta flecks) linked with its 4.1% Cr content, so that preference is given to Cr contents of at the most 2.5%, without this condition preventing the obtaining of good properties (results of FB).

TABLE 1

| COMPOSITIONS (First series of tests) ANALYSIS (% by weight) | | | | | | | | | | |
|---|---|---|---|---|---|---|---|---|---|---|
| Ref. | Al | Sn | Zr | Mo | Cr | V | Cr + V | Fe | Si | O |
| A | 4.27 | 2.13 | 3.21 | 2.04 | <0.01 | 4.3 | 4.3 | 2.15 | <0.01 | 0.125 |
| D | 4.33 | 2.12 | 3.11 | 4.11 | <0.01 | 4.26 | 4.26 | 2.13 | " | 0.126 |
| E | 3.96 | 2.00 | 3.14 | 4.05 | 4.28 | 4.00 | 8.28 | <0.01 | " | 0.101 |
| H | 4.05 | 0 | 0 | 3.99 | <0.01 | 3.91 | 5.94 | 2.03 | " | 0.124 |
| J | 4.09 | 2.00 | 2.94 | 3.95 | 1.99 | <0.01 | 1.99 | 1.91 | " | 0.119 |
| K | 3.81 | 1.93 | 3.10 | 3.79 | 4.28 | <0.01 | 4.28 | <0.01 | " | 0.106 |

TABLE 2

| First series of tests: transus temperature and forging temperature and heat treatments of the first range (°C.) | | | | | |
|---|---|---|---|---|---|
| Ref. | Estimated "beta transus" | Real "beta transus" (on the basis of tests) | Alpha-beta forging. | First Range Solution treatment | 8 h ageing before tests |
| A | 840 | 900 | 790 | 850 | 630 |
| D | 810 | 880 | 760 | 830 | 610 |
| E | 810 | 800 | 760 | 750 | 530 |
| H | 760 | 880 | 710 | 830 | 610 |
| J | 810 | 900 | 750 | 850 | 630 |
| K | 830 | 840 | 780 | 790 | 570 |

TABLE 3

| Mechanical characteristics: First series of tests, first range | | | | | | | | | |
|---|---|---|---|---|---|---|---|---|---|
| | | | | Mechanical characteristics at 20° C. | | | | Creep time 400° C.-600 MPa (h) after annealing | |
| Ref. and range No. | Observations on transformation. | Specific gravity (g/cm³) | Sense | Rm (MPa) | $R_p$ 0.2 (MPa) | A % | KIC (MPa.√m) | for 0.2% | for 0.5% |
| A1 | alpha-beta forging (Table 2) | 4.688 | L | 1295 | 1210 | 14 | 66 | 49 | 22 |
| | | | T | 1386 | 1324 | 6 | 64 | | |
| D1 | solution treatment at ("beta transus" −50° C.) and air cooling. | 4.741 | L | 1167 | 1125 | 8 | 60 | 21.2 | 96.5 |
| | | | T | 1166 | 1156 | 5 | 40 | | |
| E1 | | 4.633 | L | 1023 | 1000 | 15 | 74 | 25.7 | 134 |
| | | | T | 1080 | 1070 | 10 | 85 | | |
| H1 | | 4.633 | L | 1092 | 1069 | 9 | 87 | — | 4 |
| | | | T | 1181 | 1164 | 11 | 83 | | |
| J1 | Ageing (Table 2) only before creep test | 4.742 | L | 1386 | 1317 | 7 | 56 | 16.2 | 80 |
| | | | T | 1460 | 1417 | 7 | 49 | | |
| K1 | | 4.622 | L | 1126 | 1066 | 8 | 90 | 21.7 | 139 |
| | | | T | 1120 | 1100 | 8 | 68 | | |

TABLE 4

| Mechanical characteristics: First series of tests, second range | | | | | | | |
|---|---|---|---|---|---|---|---|
| | | | Mechanical characteristics at 20° C. | | | Creep 400° C. 600 MPa (h) | |
| Ref. and range No. | Observations on transformation | Sense | Rm (MPa) | $R_p$ 0.2 (MPa) | A % | 0.2% | 0.5% |
| A2 | Final forging from "beta transus" +10° C. to alpha-beta, | L | 1206 | 1113 | 9.3 | 20.7 | 137 |
| D2 | solution treatment 1 h at "beta | L | 1651 | 1595 | 1.4 | 12 | 89.4 |
| E2 | transus" −30° C. and air cooling and ageing | L | 1486 | 1433 | 4.5 | 21.6 | 112 |
| J2 | 8 h at 550° C. (A2) or | L | 1580 | 1504 | 0.6 | 18.8 | 279 |
| K2 | 500° C. (D2 to K2) | L | 1286 | 1158 | 6 | 67.5 | 144 |

TABLE 5

| Ref. | Observations on transformation | Sense | Mechanical characteristics at 20° C. Rm (MPa) | $R_p$ 0.2 (MPa) | A % |
|---|---|---|---|---|---|
| | Mechanical characteristics: First series of tests, third range | | | | |
| A3 | final forging from "beta transus" +30° C. | L | Fracture on tensioning | | |
| D3 | to alpha-beta, solution treatment | L | 1716 | 1665 | 0.50 |
| E3 | 1 h at "beta transus" −30° C. and air cooling, ageing | L | 1530 | 1438 | 1.66 |
| J3 | 8 h at 550° C. (A3) or 500° C. (D3 to K3) | L | Fracture on tensioning | | |
| K3 | | L | 1390 | 1224 | 5.00 |

TABLE 7

| Ref. | Al | Sn | Zr | Mo | Cr | V | Cr + V | Fe | Si | O |
|---|---|---|---|---|---|---|---|---|---|---|
| | Compositions (second series of tests) Analysis (% by weight) | | | | | | | | | |
| AB2 | 5.2 | 2.0 | 3.9 | 3.9 | 4.1 | <0.01 | 4.1 | <0.01 | <0.01 | 0.073 |
| CB | 4.7 | 1.7 | 3.7 | 1.8 | 2.0 | 2.0 | 4.0 | <0.01 | " | 0.068 |
| FB | 5.4 | 2.0 | 4.2 | 4.0 | 2.1 | <0.01 | 2.1 | 1.1 | " | 0.072 |
| GB | 4.6 | 2.0 | 3.7 | 3.5 | 1.9 | 1.8 | 3.7 | <0.01 | " | 0.071 |
| KB | 5.5 | 2.9 | 5.0 | 4.2 | 4.2 | 4.1 | 8.3 | <0.01 | " | 0.082 |

TABLE 8

| Second series of tests: real "beta transus", final forging temperature and heat treatment (°C.) | AB2 | CB | FB | GB | KB |
|---|---|---|---|---|---|
| real "beta transus" | 870 | 900 | 880 | 870 | 880 |
| start of final forging ("beta transus" +30° C.) | 900 | 930 | 910 | 900 | 910 |
| end of final forging | <870 | <900 | <880 | <870 | beta |
| solution treatment at (beta transus −30° C.) | 840 | 870 | 850 | 840 | 850 |
| ageing | 600 | 560 | 620 | 580 | 600 |

1. A wrought and heat treated titanium alloy part, comprising, by weight: Al 4.5 to 5.4%, Sn 1.8 to 2.5%, Zr 3.5 to 4.8%, Mo 2.0 to 4.5%, Cr 1.5 to 2.5%, Cr+V 1.5 to 4.5%, Fe 0.7 to 1.5%, O 0.07 to 0.13%, the remainder being Ti and impurities, said part having a fine and regular alpha-beta structure and essentially segregation free microstructures, and having the mechanical characteristics: $R_m \geqq 1200$ MPa, $R_{p0.2} \geqq 1000$ MPa, $A\% \geqq 5$, $K_{1C}$ at 20° C. $\geqq 45$ MPa.$\sqrt{m}$, creep at 400° C. under 600 MPa: 0.5% in more than 200 hours.

2. Part according to claim 1, wherein Zr=4.1 to 4.8%.

TABLE 9

| Ref. | Observations on transformation | Sense | Mechanical characteristics at 20° C. Rm (MPa) | $R_p$ 0.2 (MPa) | A % | KIC (MPa.$\sqrt{m}$) | Creep 400° C. 600 MPa (h) 0.2% | 0.5% |
|---|---|---|---|---|---|---|---|---|
| | Mechanical characteristics: Second series of tests | | | | | | | |
| AB2 | After alpha-beta forging, final | L | 1348 | 1280 | 4.4 | 57 | 22 | 155 |
| | forging, from "beta transus" +30° C. to | T | 1361 | 1299 | 0.4 | 41 | | |
| CB | alpha-beta (except for KB) solution | L | 1119 | 1026 | 7.6 | 80 | 27 | 182 |
| | treatment 1 h at "beta transus" | T | 1177 | 1059 | 5.2 | 75 | | |
| FB | −30° C. and air cooling and ageing for 8 h | L | 1297 | 1206 | 6.9 | 51 | 48.5 | 384 |
| | at temperature chosen between 560 and 620° C. (see Table 7) | T | 1374 | 1294 | 1.2 | 38 | | |
| GB | | L | 1215 | 1111 | 8.4 | 74 | 25 | 243 |
| | | T | 1233 | 1125 | 1.5 | 55 | | |
| KB | | L | 1328 | 1235 | 3.6 | 26 | 201 | (0.285% in 313 h) |
| | | T | 1347 | 1275 | 0.9 | | | |

We claim:

* * * * *